United States Patent [19]

Tolliver

[11] Patent Number: 4,489,528

[45] Date of Patent: Dec. 25, 1984

[54] CAGE SPACER

[76] Inventor: Wilbur E. Tolliver, 364 Hamilton, Holland, Mich. 49423

[21] Appl. No.: 409,321

[22] Filed: Aug. 18, 1982

[51] Int. Cl.[3] ..... E04C 5/16

[52] U.S. Cl. ..... 52/677; 52/745

[58] Field of Search ..... 52/650–654, 52/677–689, 745

[56] References Cited

U.S. PATENT DOCUMENTS

| | | | |
|---|---|---|---|
| 1,024,260 | 4/1912 | Hickman | 52/687 |
| 1,442,160 | 1/1923 | Lachman . | |
| 1,539,378 | 5/1925 | White . | |
| 1,621,183 | 3/1927 | White | 52/684 |
| 1,672,176 | 6/1928 | Schumacher et al. . | |
| 1,684,195 | 9/1928 | Olmsted | 52/650 |
| 1,750,106 | 3/1930 | Heltzel | 52/677 |
| 1,750,286 | 3/1930 | Sherwan . | |
| 1,828,890 | 10/1931 | Cook . | |
| 1,830,202 | 11/1931 | Jenkins . | |
| 1,871,809 | 8/1932 | Lambert . | |
| 2,034,726 | 3/1936 | Menninger | 72/116 |
| 2,227,153 | 12/1940 | Prosser | 138/84 |
| 3,148,482 | 9/1964 | Neale | 50/343 |
| 3,172,239 | 3/1965 | Larkin | 50/507 |
| 3,197,171 | 7/1965 | Michalak | 52/686 |
| 3,257,767 | 6/1966 | Lassy | 52/652 |
| 3,342,003 | 9/1967 | Frank | 52/664 |
| 3,411,543 | 11/1968 | Osweiler | 138/175 |
| 3,411,544 | 11/1968 | Keyser | 138/175 |
| 3,411,545 | 11/1968 | Keyser | 138/175 |
| 3,411,546 | 11/1968 | Osweiler | 138/175 |
| 3,419,047 | 12/1968 | Osweiler | 138/175 |
| 3,440,792 | 4/1968 | Schmidgall | 52/687 |
| 3,471,986 | 10/1969 | Swenson | 52/652 |
| 3,512,329 | 5/1970 | Du Plessis | 52/665 |
| 3,722,164 | 3/1973 | Schmidgall | 52/684 |
| 3,861,096 | 1/1975 | Emmons | 52/98 |
| 3,895,470 | 7/1975 | Wurth | 52/686 |
| 4,031,685 | 6/1977 | Heinz | 52/653 |

FOREIGN PATENT DOCUMENTS 2821562 11/1978 Fed. Rep. of Germany .

*Primary Examiner*—James L. Ridgill, Jr.

*Attorney, Agent, or Firm*—Price, Heneveld, Huizenga & Cooper

[57] ABSTRACT

The specification discloses a spacer for use with first and second wire reinforcing fabrics to space the first and second fabrics one from the other during the manufacture of wire reinforced concrete articles. The spacer includes a spacing member, first and second camming members extending from the spacing member in a generally common direction to cammingly engage the fabrics, and first and second locking portions operatively extending from the first and second camming members, respectively, to aid in positioning and securing the spacer on the fabrics. An assembly incorporating the spacer and a method of using the spacer are also disclosed.

43 Claims, 10 Drawing Figures

CAGE SPACER

BACKGROUND OF THE INVENTION

The present invention relates to a spacer for wire reinforcement used in the manufacture of welded wire reinforced concrete articles such as pipe, and more specifically to a spacer for maintaining concentric wire reinforcement cages in spaced relationship from each other and the pipe form when concrete is formed around the wire reinforcement.

A wire reinforcing assembly typically comprises wire fabric formed to generally conform to the shape of the article being produced. For example, in manufacturing a wire reinforced concrete pipe, the fabric is shaped into a generally cylindrical cage having a smaller diameter than the outer cylindrical pipe form in which the pipe is to be cast. Often, a second cylindrical cage having a diameter somewhat smaller than that of the first cylindrical cage is included to further reinforce the concrete pipe.

In the manufacture of a wire reinforced concrete pipe, it is important that the cage assembly be located in the pipe form a spaced distance from the pipe form wall or walls. When a single external wall form is used and the pipe is dry cast in a packer head machine, the cage assembly must be spaced from the external wall. When a double wall form is utilized and the concrete is to be cast around the cage assembly, the assembly must be spaced from both the inner and outer walls. Further, to insure the structural integrity of the pipe, it is important that the two cylindrical cages in the assembly be maintained in fixed concentric relationship with respect to each other during manufacture. Various spacing devices exist in the prior art for performing these spacing functions, but none is completely satisfactory.

Often, the two concentric cages are tied with wire ties to common spacer bars oriented generally radially with respect to the cages. These spacer bars extend radially outwardly beyond the outer cage and/or radially inwardly beyond the inner cage to engage the pipe form to maintain the cage assembly in proper spaced orientation within the form during casting. Alternatively, the spacer bars can be welded to the cylindrical cages. In any event, the attachment of these spacer bars to the cages is extremely time consuming, whether they are tied using wire ties or welded. Additionally, the unfinished rod ends which engage the pipe form to space the assembly from the form may scratch, or score, the form destroying its smooth surface. Further, these rods can be bent when the cage assembly is inserted into the form or during subsequent casting, which destroys the desired accurate spacing between the cage and the pipe form.

Another spacer for maintaining cylindrical cages in concentric relationship includes an elongated spacer member having a J-hook at one end and a C-hook at an opposite end. (U.S. Pat. No. 3,440,792 to Schmidgall which issued Apr. 29, 1969) The J-hook is looped around a wire of one cage while the C-hook is cammed onto a wire of the second cage. A portion of the C-hook extends beyond the second cage to engage the pipe form. However, because the spacers include no locking structure at either one end, they do not positively retain the inner and outer cages in fixed relation. Further, because the spacer includes structure at only one end of the elongated member for spacing the cage assembly from the form, these spacers must be carefully alternated in orientation on the inner and outer cages to provide proper spacing within the pipe form.

Yet another spacer includes a bent metal member having first and second flanges extending from opposite sides thereof. The flanges are welded to inner and outer cages in order to properly maintain the inner and outer cages in proper orientation with respect to each other. The required welding is extremely time consuming and expensive. Further, these spacers do not include any provision for spacing the assembly from either of the form walls. Therefore, either the cage assembly is not properly oriented within the form or additional spacing means must be installed on the assembly in order to properly orient the assembly within the form.

SUMMARY OF THE INVENTION

The aforementioned problems are solved by the present invention wherein a cage spacer is provided including a spacing member having first and second ends, and first and second mounting structure operably connected to the first and second ends, respectively, for mounting and locking the spacer on the inner and outer cages. A plurality of spacers are mounted about the concentric cages to maintain the cages in spaced relationship with respect to one another during casting. In a preferred embodiment, the first and second mounting structure include first and second camming structure, respectively, for camming the spacer into engagement with the concentric cages.

Because the spacer of the present invention provides mounting, or camming, structure for securing the spacer to both the inner and outer cages, the spacer is positively secured on the cages to maintain them in fixed, concentric relationship. Further, the spacer may be readily installed on a cage assembly because it is simply cammed into position on both the inner and outer cages. No subsequent operations are required such as welding or wire typing to maintain the spacer on the cages.

In another preferred embodiment, an integral spacer portion extends from at least one of the first and second mounting structure to space the cage assembly from one or both of the inner and outer form walls. This embodiment eliminates the need for separate spacer members to space the cage assembly from the form.

These and other objects, advantages, and features of the invention will be more readily understood and appreciated by reference to the written specification and appended drawings.

DESCRIPTION OF THE PREFERRED EMBODIMENT

Figure 1:
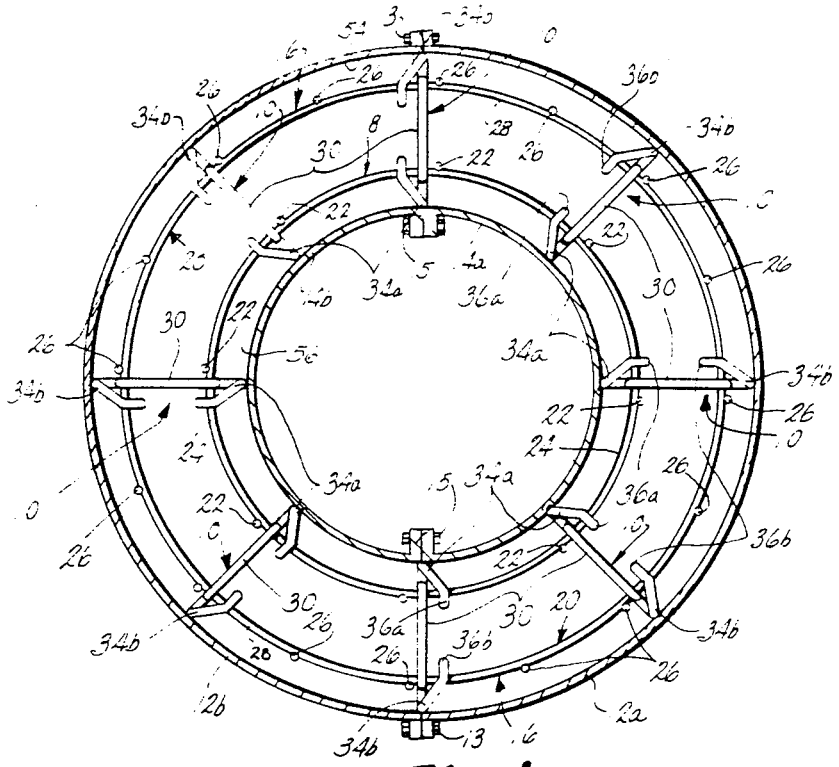
FIG. 1 is a sectional view of a wire reinforcing cage with reinforcement spacers constructed in accordance with the present invention installed thereon inserted within a concrete form having inner and outer walls.

In FIG. 1, a plurality of spacers 10 are shown utilized in a conventional environment for constructing a reinforced concrete pipe. Outer form halves 12*a* and 12*b* are joined together to define outer form 12. Likewise, inner form halves 14*a* and 14*b* are connected to form inner form 14. Both outer form 12 and inner form 14 are generally circular in cross section and oriented generally concentrically. When this double wall type form is used, the concrete is cast, or poured, between forms 12 and 14 to fabricate the concrete pipe. Cage or fabric assembly 16 is mounted between forms 12 and 14. Consequently, when the concrete is cast between forms 12 and 14, the concrete and cage assembly 16 together form a reiforced concrete pipe. Such a pipe is later removed from the form by separating outer form halves 12*a* and 12*b* and withdrawing inner form 14 from the interior of the cast pipe.

Cage assembly 16 (FIG. 1) generally comprises inner cage 18, outer cage 20, and spacers 10 interconnecting the two cages. Inner cage 18 is formed by forming wire fabric comprised of longitudinal, or transverse, wires 22 and circumferential wires 24 into a cylindrical configuration. Similarly, outer cage 20 is formed by forming wire fabric comprised of longitudinal or transverse wires 26 and circumferential wires 28 into a similar cylindrical configuration. As shown, longitudinals 22 and 26 are on the outside of circumferentials 24 and 28, respectively, but it is understood that spacer 10 of the present invention works equally well if longitudinals 22 and 26 are on the inside of the circumferentials. Spacers 10 are typically mounted on the circumferentials 24 and 28 of cages 18 and 20 at spaced points around and along the length of the cages.

Each spacer 10 (FIGS. 3 and 4) is fabricated from low carbon, cold drawn steel and comprises a bar 30 which serves to space inner cage 18 from outer cage 20. Extending in a generally common lateral direction from bar 30 are camming members or portions 32*a* and 32*b*. Extending generally oppositely from camming portions 32*a* and 32*b*, respectively, are spacing portions 34*a* and 34*b*. Then extending generally towards one another from spacing portions 34*a* and 34*b* are wire-engaging (or positioning or locking) portions 36*a* and 36*b*. When spacers 10 are mounted on cage assembly 16 (FIG. 1), camming portions 32*a* and 32*b* and locking portions 36*a* and 36*b* cooperate to cause spacer 10 to be securely clipped to assembly 16. Further, spacing portions 34*a* and 34*b* engage inner and outer forms 14 and 12, respectively, to maintain assembly 16 in the proper position within the form.

As shown in FIGS. 1, 2, 3, and 4, spacers 10 are positioned on longitudinal wires 22 and 26 of the inner and outer cages. When so positioned, camming portions 32*a* and 32*b* cammingly engage circumferentials 24 and 28, respectively, and locking portions 36*a* and 36*b* extend around these longitudinals. Spacers 20 may alternatively be mounted on longitudinals 22 and 26 just as easily if the longitudinals happen to be located generally opposite one another when the cages are positioned one within the other. However, spacer 10 will be described as mounted only on circumferentials with the description being equally applicable when spacer 10 is mounted on longitudinals, since the circumferentials will always be generally opposite one another.

Figure 2:
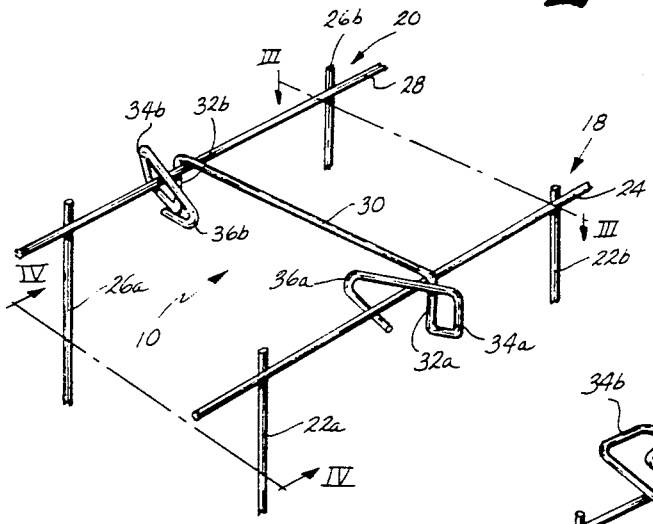
FIG. 2 is a perspective view of one spacer mounted on the wire fabric.
Figure 3:
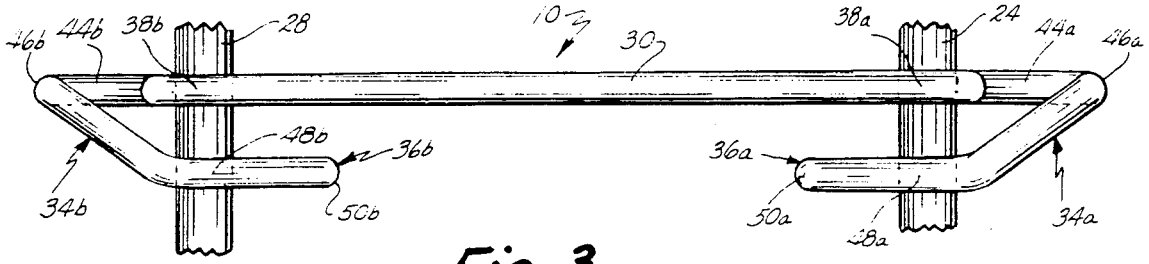
FIG. 3 is a view taken along plane III—III in FIG. 2.
Figure 4:
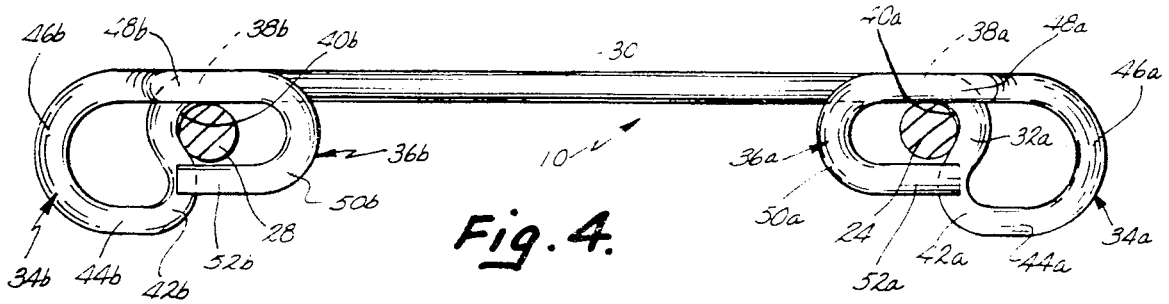
FIG. 4 is a view taken along plane IV—IV in FIG. 2.
Figure 8:
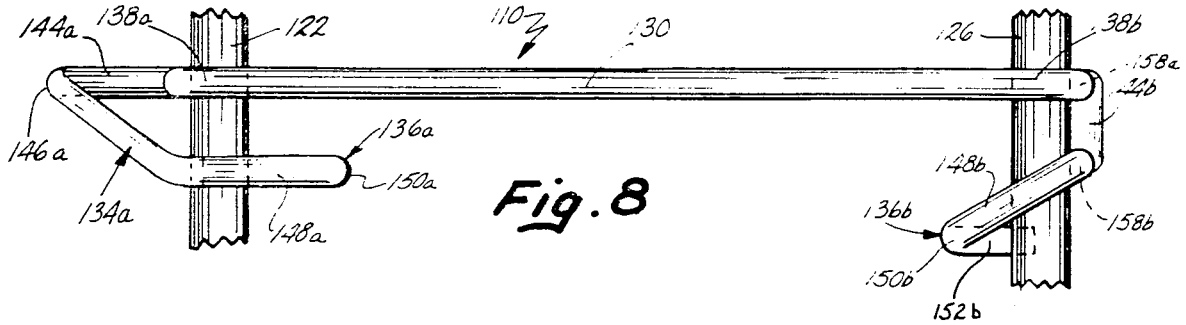
FIG. 8 is a view taken along plane VIII—VIII in FIG. 7.
Figure 9:
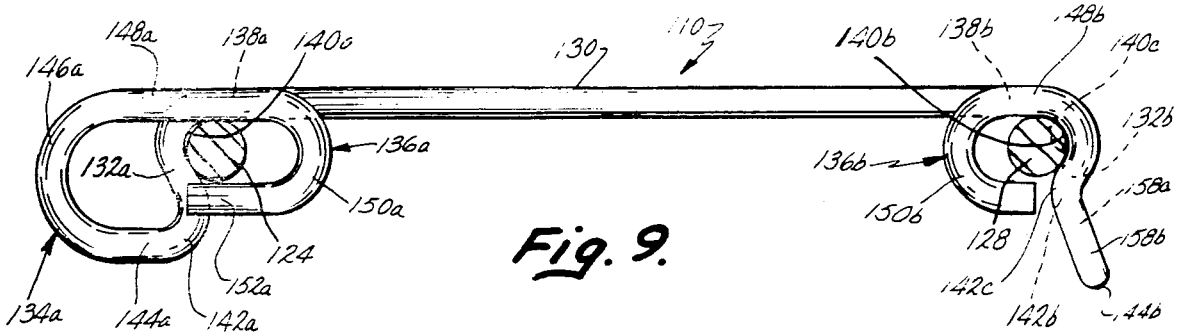
FIG. 9 is a view taken along plane IX—IX in FIG. 7.

Cage spacer 10, as shown in FIGS. 2, 3, and 4, is made of a single piece of wire shaped to form bar 30, with bar ends 38*a* and 38*b*, camming members 32, spacing portions 34 and positioning portions 36. The length of generally linear bar 30 is selected to conform with the desired spacing between inner cage 18 and outer cage 20 in the concrete pipe. This spacing will vary with the diameter of the pipe, the thickness of the pipe wall, and the desired strength, among other considerations.

Camming members 32*a* and 32*b* extend from bar 30 at bar ends 38*a* and 38*b*, respectively. Camming members 32 extend in a generally common lateral direction, for example, as shown in FIG. 4, downwardly. Camming members 32*a* and 32*b* extend slightly inwardly toward each other to define pockets 40*a* and 40*b*, respectively, and then outwardly away from each other to define camming lobes 42*a* and 42*b*, respectively. When spacer 10 is properly mounted on cage assembly 16, circumferentials 24 and 28 are secured within pockets 40*a* and 40*b*.

U-shaped spacing portions 34*a* and 34*b* extend from camming lobes 42*a* and 42*b*, respectively. Lower legs 44*a* and 44*b* of spacing portions 34 are generally parallel to bar 30. Form-engaging bights 46*a* and 46*b* extend from lower legs 44 and continue into upper legs 48*a* and 48*b*, which are also generally parallel to bar 30 and engage circumferentials 24 and 28 when spacer 10 is mounted on assembly 16.

Locking portions 36*a* and 36*b* extend about opposite sides of circumferentials 24 and 28, respectively, to aid in preventing spacer 10 from shifting transversely of, or with respect to, the circumferentials. Indeed locking portions 36*a* and 36*b* help prevent cages 18 and 20 from shifting toward or away from one another. Portions 36*a* and 36*b* include bights 50*a* and 50*b*, which extend from upper legs 48*a* and 48*b* around circumferentials 24 and 28 and positioning legs 52*a* and 52*b*, which are opposite upper legs 48*a* and 48*b*. Positioning legs 52*a* and 52*b* are laterally offset from bar 30, permitting the circumferentials to be positioned therebetween during installation as will be described. Bights 50 are located generally opposite pockets 40.

OPERATION

Figure 5:
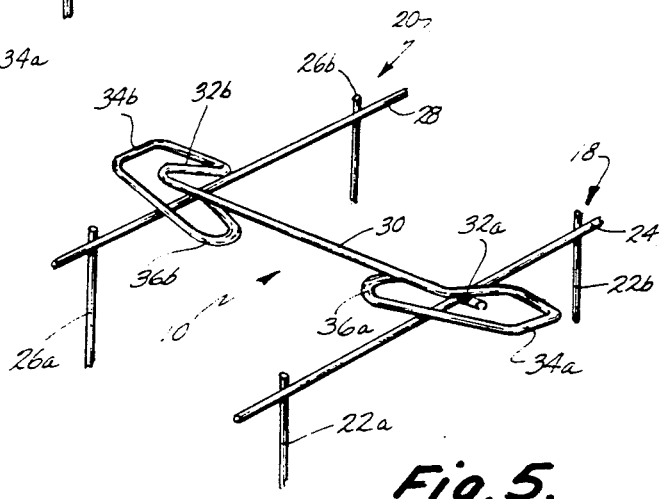
FIG. 5 is a view similar to FIG. 2 showing the spacer only partially installed on the wire fabric.

Spacer 10 is mounted on cage assembly 16 by first abutting spacing portions 34*a* and 34*b* against circumferentials 24 and 28, respectively, as shown in FIG. 5. When so oriented, positioning portions 36 extend beyond a plane defined by circumferentials 24 and 28, and bar 30 is oriented at a nonperpendicular angle to circumferentials 24 and 28. Next, spacer portion 34*b* is slid along circumferential 28 toward longitudinal 26*b* and spacer portion 34*a* is slid along circumferential 24 toward longitudinal 22*a* until bar 30 is oriented generally perpendicularly to both circumferentials. At this point, circumferentials 24 and 28 are positioned between bar 30 and legs 52*a* and 52*b*, respectively; and camming lobes 42*a* and 42*b* abut the circumferentials. Spacer 10 is then rotated about an axis passing through positioning legs 52*a* and 52*b* so that camming lobes 42*a* and 42*b* cam onto circumferentials 24 and 28 until the circumferentials are positioned in pockets 40.

When so mounted, spacer 10 is securely retained on assembly 16. Circumferential 24 is secured within both pocket 40*a* and locking portion 36*a;* and circumferential 28 is secured within both pocket 40*b* and positioning portion 36*b*. Locking portions 36 prevent spacer 10 from being inadvertently knocked off the circumferentials. Preferably, each spacer 10 is located near a longitudinal wire which helps prevent spacer 10 from shifting along the length of the circumferential. Before assembly 16 is positioned within form 12, a plurality of spacers 10 are mounted along both the length and circumference of assembly 16 at strategic positions. Cage 16 is then inserted within form 12 so that each of form-engaging bights 46*b* engages interior surface 54 of outer form 12 and each of form-engaging bights 46*a* engage the exterior surface 56 of inner form 14. When assembled in this manner, assembly 16 is properly spaced from both forms 12 and 14. Further, inner and outer cages 18 and 20 are maintained in fixed relationship with respect to one another and with respect to forms 12 and 14. Finally, concrete is cast between forms 12 and 14 and around assembly 16 so as to form a section of concrete pipe.

ALTERNATIVE EMBODIMENT

Figure 6:
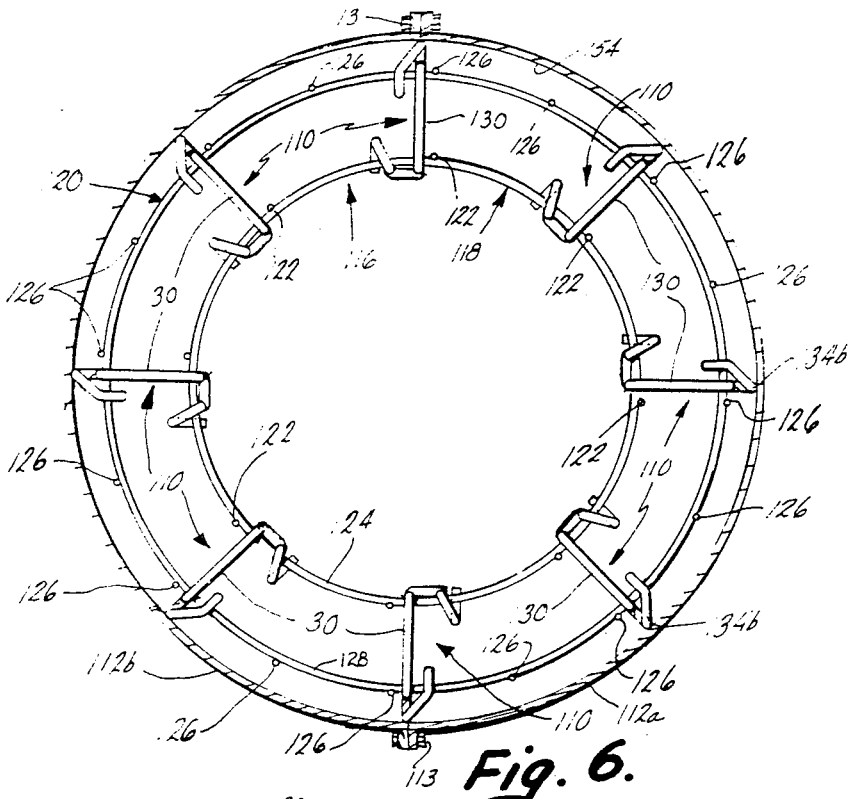
FIG. 6 is a sectional view of a wire reinforcing cage with alternative embodiment reinforcement spacers installed thereon inserted within a concrete form having a single outer wall.
Figure 7:
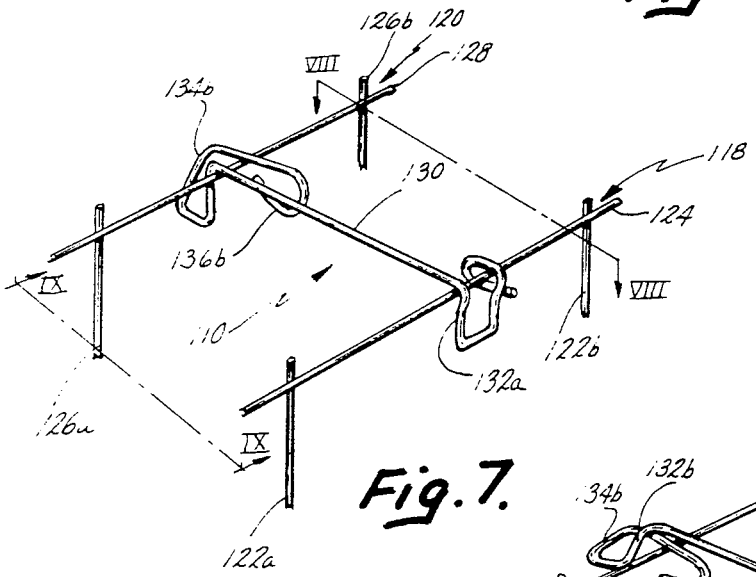
FIG. 7 is a perspective view of one alternative spacer mounted on the wire fabric.

An alternative embodiment 110 of the cage spacer is shown in FIGS. 6–10, wherein elements identical to elements in FIGS. 1–5 have numbers identical thereto preceded by a 1 (e.g., outer pipe form 112 in FIG. 6 corresponds to outer form 12 in FIG. 1). The major difference between alternative embodiment 110 and previous embodiment 10 is that spacing portion 34*b* is not included on the alternative embodiment. Consequently, lower arm 144*b* extending from camming lobe 142*b* extends into locking portion 136*b* rather than a spacing portion. Consequently, cage spacer 110 provides means for spacing assembly 116 from only an exterior form 112.

In FIG. 6, reference numeral 112 designates a single, external form utilized in construction of concrete pipe by use of a packer head machine. In the use of this single, form, the concrete is packed by the packer head on the inner surface 154 of form 112. Cage assembly 116 is mounted inside form 112 and spaced form inner surface 154 so that when the concrete is packed against inner surface 154, the concrete will be packed around assembly 116 so as to form a reinforced concrete pipe. Concentric inner and outer cages 118 and 120 are included to insure the structural integrity of the resulting pipe. The cured pipe is removed from form 112 by separating the form halves 112*a* and 112*b*.

Spacers 110 are shown positioned on circumferential wires 124 and 128 along both the circumference and length of assembly 116. As with the previously described embodiment, alternative spacers 110 can be mounted with equal applicability on longitudinals 122 and 126 if they are favorably located in the assembly.

Bar 130, camming member 132*a*, form-spacing portion 134*a*, and locking portion 136*a* of alternative spacer 110 are identical to their counterparts in previous spacer 10. Consequently, a detailed description of their structure and function is not necessary.

However, the structure extending from spacer bar 130 at bar end 138*b* is different from the corresponding structure in the previously described spacer 10. Camming member 132*b* extends from bar end 138*b* and extends first toward camming portion 132*a* to form pocket 140*b* and then away from camming portion 132*a* to define camming lobe 142*b*. Side arm 158*a* extends downwardly from camming lobe 142*b*. Lower leg 144*b* extends laterally from arm 158*a*, and side arm 158*b* extends upwardly from leg 144*b*. Side arms 158*a* and 158*b* are generally parallel to one another and perpendicular to lower leg 144*b*. Side arm 158*b* terminates in camming lobe 142*c* which engages circumferential 128 in the same fashion as its counterpart 142*b*. Spacer 110 then continues to define pocket 140*c* and extends around circumferential 128 to form upper leg 148*b*. Bight 150*b* extends from upper leg 148*b* around circumferential 128, terminating in positioning leg 152*b* positioned proximate circumferential 128 parallel to and opposite spacer bar 130.

Figure 10:
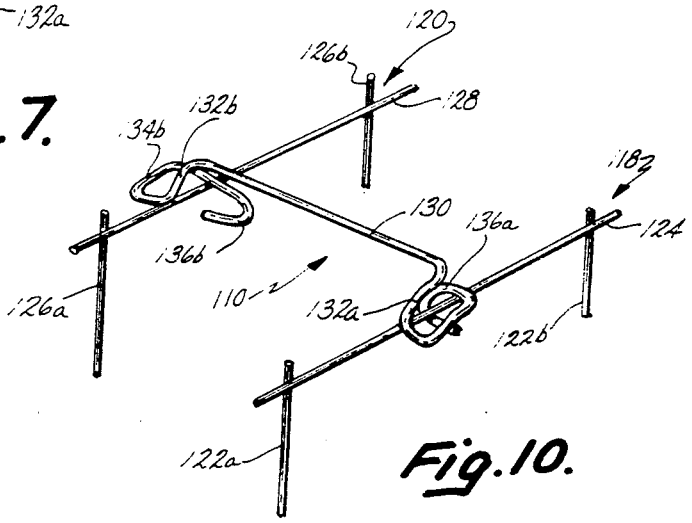
FIG. 10 is a view similar to FIG. 7 showing the spacer only partially installed on the wire fabric.

Alternative spacer 110 is mounted on circumferentials 124 and 128 by first abutting spacing portion 134*a* against circumferential 128 and side arm 158*b* against circumferential 124 as shown in FIG. 10. In this position, both positioning legs 152*a* and 152*b* lie on the opposite side of a plane defined by the circumferentials from spacer bar 130. Next, locking portion 134*b* is slid along circumferential 128 toward longitudinal 126*b* and side arm 158*b* is slid along circumferential 124 toward longitudinal 122*a* until spacer bar 130 is generally perpendicular to both of the circumferentials. At this point, circumferentials 124 and 128 are positioned between upper legs 148 and positioning legs 152, and camming lobes 142*a* and 142*c* engage circumferentials 124 and 128, respectively. Alternative spacer 110 is then rotated about an axis extending through upper arms 148 so that camming lobes 142*a*, 142*b*, and 142*c* all cam onto the circumferentials so that circumferential 124 is positioned in pocket 140*a* and circumferential 128 is positioned in pockets 140*b* and 140*c*.

When so installed, alternative spacer 110 is securely retained on inner and outer cages 18 and 20. Camming members 132 prevent alternative spacer 110 from moving laterally with respect to the circumferentials, and locking portions 136 prevent alternative spacer 110 from moving radially to any significant extent with respect to the circumferentials. Before assembly 116 is mounted inside form 12, a plurality of spacers 110 are mounted along both the circumference and the length of the assembly at strategic positions. Assembly 116 is then inserted into form 112 so that each of spacing portions 134*a* engages interior surface 154 of form 112. When assembled in this manner, assembly 116 is properly spaced from form 112, and inner and outer cages 118 and 120 are maintained in fixed concentric relationship. Finally, a packer head (not shown) packs concrete around assembly 116 so as to form a section of concrete pipe.

It should be understood that the above description is intended to be that of preferred embodiments of the invention. For example, spacers 10 and 110 can be used to space flat sheets of fabric assemblies of tied or supported rod or rebar rod, the inner and outer reinforcements of a box culvert or like reinforcement means. In that regard, the term "wire" as used in the claims is also intended to encompass "rod".

As shown in the drawings, locking portions 36 are shown as generally "U" shaped members. However, they could be more circular or arcuate in configuration. Manufacture might be facilitated with the more circular shape. The term "generally U-shaped" as used in the claims is intended to cover this variation as well. Also, the types of concrete forms used could vary, as well as methods for removing same. Instead of opening the inner and outer forms, overhead stripping techniques could be used.

Thus, various changes and alterations might be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A spacer for use with first and second concrete reinforcing members in the manufacture of reinforced concrete articles to space said first and second members one from the other, said first member including a plurality of first wires and said second member including a plurality of second wires, said spacer comprising:

a spacing member having first and second ends;

a first camming member extending from said first end adapted to cammingly engage only one side of one of said first wires;

a second camming member extending from said second end adapted to cammingly engage only one side of one of said second wires;

a first locking portion operatively connected to said first camming member adapted to extend about the remaining sides of said one first wire to aid in preventing said spacer from being inadvertently dislodged from said one first wire; and a second locking portion operatively connected to said second camming member adapted to extend about the remaining sides of said one second wire to aid in preventing said spacer from being inadvertently dislodged from said one second wire.

2. A spacer as defined in claim 1 wherein at least one of said first and second locking portions comprises pivot means for engaging at least one of said one first wire and said one second wire to provide a pivot axis about which said spacer can be pivoted to cam said first and second camming members into engagement with said one first wire and said one second wire, respectively.

3. A spacer as defined in claim 2 wherein both of said first and second locking portions comprise said pivot means.

4. A spacer as defined in claim 1 further comprising a first form-spacing portion integral with said first camming member and operatively extending away from said first end of said spacing member in a first direction to space said one first wire from a first form wall.

5. A spacer as defined in claim 4 wherein said first form-spacing portion is also integral with said first locking portion.

6. A spacer as defined in claim 4 further comprising a second form-spacing portion integral with said second camming member and operatively extending away from said second end of said spacing member in a second direction generally opposite to said first direction for spacing said one second wire from a second form wall.

7. A spacer as defined in claim 6 wherein said first form-spacing portion is also integral with said first locking portion.

8. A spacer as defined in claim 7 wherein said second form-spacing portion is also integral with said second locking portion.

9. A spacer as defined in claim 1, 4, or 6 wherein said first and second locking portions are generally U-shaped.

10. A spacer as defined in claim 9 wherein said spacer is formed from an integral piece of wire.

11. A spacer as defined in claim 1, 4, 6, 5, 7, or 8 wherein said spacer is formed from an integral piece of wire.

12. A spacer for use with first and second wire reinforcing members in the manufacture of reinforced concrete articles to maintain said first and second members in spaced relationship, said first member including a plurality of first wires and said second member including a plurality of second wires, said spacer comprising:

a spacing member having first and second ends;

first mounting means operatively connected to said first end for mounting said spacer on one of said first wires, said first mounting means including first camming means for camming said first mounting means into engagement with said one first wire, said first mounting means further including a first pivot leg engaging said one first wire during installation of said spacer; and second mounting means operatively connected to said second end for mounting said spacer on one of said second wires, said second mounting means including second camming means for camming said second mounting means into engagement with said one second wire, said second mounting means further including a second pivot leg engaging said one second wire during installation of said spacer, said first and second pivot legs together providing a pivot axis about with said spacer can be twisted during installation to facilitate camming said spacer onto said wires.

13. A spacer as defined in claim 12 wherein:

said first mounting means further includes a first locking portion adapted to extend about opposite sides of said one first wire to aid in preventing said spacer from shifting transversely of said one first wire, said first mounting means substantially surrounding said one first wire; and said second mounting means further includes a second locking portion adapted to extend about opposite sides of said one second wire to aid in preventing said spacer from shifting transversely of said one second wire, said second mounting means substantially surrounding said one second wire.

14. A spacer as defined in claim 13 wherein said first and second locking portions are generally U-shaped.

15. A spacer as defined in claim 13 wherein at least one of said first and second mounting means includes a form-spacing portion integral with and extending from said camming means generally opposite said spacing member.

16. A spacer as defined in claim 15 wherein said first and second locking portions are generally U-shaped.

17. A spacer as defined in claim 15 wherein said form-spacing portion is integral with both said camming means and said locking portion.

18. A spacer as defined in claim 17 wherein said first and second locking portions are generally U-shaped.

19. A concrete reinforcement assembly including first and second reinforcing members, said first member including a plurality of first wires and said second member including a plurality of second wires, and means for spacing said first and second members, one from the other, wherein the improvement comprises said spacing means including a plurality of spacers, each comprising:

a spacing member having first and second ends;

a first camming member extending from said first end adapted to cammingly engage only one side of one of said first wires;

a second camming member extending from said second end adapted to cammingly engage only one side of one of said second wires;

a first locking portion operatively connected to said first camming member adapted to extend about the remaining sides of said one first wire to aid in preventing said spacer from being inadvertently dislodged from said one first wire; and a second locking portion operatively connected to said second camming member adapted to extend about the remaining sides of said one second wire to aid in preventing said spacer from being inadvertently dislodged from said one second wire.

20. An assembly as defined in claim 19 wherein at least one of said first and second locking portions comprises pivot means for engaging at least one of said one first wire and said one second wire to provide a pivot axis about which said spacer can be pivoted to cam said first and second camming members into engagement with said one first wire and said one second wire, respectively.

21. An assembly as defined in claim 20 wherein both of said first and second locking portions comprise said pivot means.

22. An assembly as defined in claim 19 wherein each of said spacers further comprises a first form-spacing portion integral with said first camming member and operatively extending away from said first end of said spacing member in a first direction to space said one first wire from a first form wall.

23. An assembly as defined in claim 22 wherein each of said first form-spacing portions is also integral with said first locking portion.

24. An assembly as defined in claim 22 wherein each of said spacers further comprises a second form-spacing portion integral with said second camming member and operatively extending away from said second end of said spacing member in a second direction generally opposite to said first direction to space said one second wire from a second form wall.

25. An assembly as defined in claim 24 wherein each of said first form-spacing portions is also integral with said first locking portion.

26. An assembly as defined in claim 22 wherein each of said second form-spacing portions is also integral with said second locking portion.

27. An assembly as defined in claim 19, 22, or 24 wherein each of said first and second locking portions is generally U-shaped.

28. An assembly as defined in claim 27 wherein each of said spacers is formed from an integral piece of wire.

29. An assembly as defined in claim 19, 22, 24, or 23 wherein each of said spacers is formed from an integral piece of wire.

30. A concrete reinforcement assembly including first and second reinforcing members, said first member including a plurality of first wires and said second member including a plurality of second wires, and means for spacing said first and second members in spaced relationship one from the other in the manufacture of wire reinforced concrete articles, wherein the improvement comprises said spacing means including a plurality of spacers, each comprising:

a spacing member having first and second ends;

first mounting means operatively connected to said first end for mounting said spacer on one of said first wires, said first mounting means including first camming means for camming said first mounting means into engagement with said one first wire, said first mounting means further including a first pivot leg engaging said one first wire during installation of said spacer; and second mounting means operatively connected to said second end for mounting said spacer on one of said second wires, said second mounting means including second camming means for camming said second mounting means into engagement with said one second wire, said second mounting means further including a second pivot leg engaging said one second wire during installation of said spacer, said first and second pivot legs together providing a pivot axis about which said spacer can be twisted during installation to facilitate camming said spacer onto said wires.

31. An assembly as defined in claim 30 wherein:

each of said first mounting means further includes a first locking portion adapted to extend about opposite sides of said one first wire to aid in preventing said spacer from shifting transversely of said one first wire, said first mounting means substantially surrounding said one first wire; and each of said second mounting means further includes a second locking portion adapted to extend about opposite sides of said one second wire to aid in preventing said spacer from shifting transversely of said one second wire, said second mounting means substantially surrounding said one second wire.

32. An assembly as defined in claim 31 wherein each of said first and second locking portions are generally U-shaped.

33. An assembly as defined in claim 31 wherein at least one of said first and second mounting means on each of said spacers includes a spacing portion integral with and extending from said camming means generally opposite said spacing member.

34. An assembly as defined in claim 33 wherein each of said first and second locking portions are generally U-shaped.

35. An assembly as defined in claim 33 wherein each of said form-spacing portions is integral with both said camming means and said locking portion.

36. An assembly as defined in claim 35 wherein each of said first and second locking portions are generally U-shaped.

37. A method for spacing first and second reinforcing members one from the other, said first member including a plurality of first wires and said second member including a plurality of second wires, said method comprising:

providing a spacer having a spacing member having first and second ends, first mounting means including first camming means and first pivot means connected to said first end, and second mounting means including second camming means and second pivot means connected to said second end;

positioning a plurality of said spacers on said first and second members, each of said spacers engaging both said first and second members; and pivoting each of said spacers about said first and second pivot means to cammingly engage said first and second camming means with said first and second members, respectively, to secure said spacers on said members.

38. A method as defined in claim 37 further including:

providing a first locking portion on each of said first mounting means adapted to extend about opposite sides of said one first wire to aid in preventing said spacer from shifting transversely of said one first wire, said first mounting means substantially surrounding said one first wire; and providing a second locking portion on each of said second mounting means adapted to extend about opposite sides of said one second wire to aid in preventing said spacer from shifting transversely of said one second wire, said second mounting means substantially surrounding said one second wire.

39. A method as defined in claim 38 further including providing each of said first and second locking portions with a general U-shape.

40. A method as defined in claim 38 further including providing at least one of each of said first and second mounting means with a spacing portion integral with and extending from said camming means generally opposite said spacing member.

41. A method as defined in claim 40 further including providing each of said first and second locking portions with a general U-shape.

42. A method as defined in claim 40 further including providing each of said form-spacing portions integral with both said camming means and said locking portion.

43. A method as defined in claim 42 further including providing each of said first and second locking portions with a general U-shape.

* * * * *

UNITED STATES PATENT AND TRADEMARK OFFICE

CERTIFICATE OF CORRECTION

PATENT NO. : 4,489,528

DATED : December 25, 1984

INVENTOR(S) : Wilbur E. Tolliver

It is certified that error appears in the above-identified patent and that said Letters Patent is hereby corrected as shown below:

Column 2, line 39:
"typing" should be --tying--;

Column 5, line 44:
second occurrence of "form" should be --from--; and

Column 8, line 28:
"with" should be --which--.

Signed and Sealed this

*Twenty-third* Day of *July 1985*

[SEAL]

*Attest:*

DONALD J. QUIGG

*Attesting Officer* *Acting Commissioner of Patents and Trademarks*